United States Patent [19]

Yampolskaya

[11] Patent Number: 4,619,280

[45] Date of Patent: Oct. 28, 1986

[54] CUT AND STYLE—DEVICE FOR FASHION HAIRCUTTING-HAIRSHAPING AND HAIRSTYLING

[76] Inventor: Ludmila Yampolskaya, 1-Bogardus Pl., Ap 5M, New York, N.Y. 10040

[21] Appl. No.: 474,975

[22] Filed: Mar. 14, 1983

[51] Int. Cl.[4] ..... A45D 24/36

[52] U.S. Cl. ..... 132/45 R

[58] Field of Search ..... 152/45 R

[56] References Cited

U.S. PATENT DOCUMENTS

| | | | |
|---|---|---|---|
| 2,618,274 | 11/1952 | Nell | 132/9 |
| 2,808,840 | 10/1957 | DeSantis | 132/45 R |
| 2,818,074 | 12/1957 | Mach | 132/9 |
| 2,919,702 | 1/1960 | Olivo | 132/45 R |
| 2,936,767 | 5/1960 | McDonough | 132/45 R |
| 3,347,248 | 10/1967 | Weitzner | 132/40 |
| 3,935,870 | 2/1976 | Wall | 132/45 R |

*Primary Examiner*—Gregory E. McNeill

*Attorney, Agent, or Firm*—Pasquale A. Razzano

[57] ABSTRACT

A device is disclosed for use in fashion haircutting and hairshaping to enable a hairdresser or hairdesigner to precisely and effectively fulfill and/or record and/or re-create a predetermined haircut of any desired hair length at each and every point of a head or wig (obviously, within the limits of the given length of hair). The device includes a principal part—a sheet of smooth, thin, flexible, transparent and water impervious material—adapted to be placed and fit in any of a plurality of circumferential positions at various preselected levels on human head (or a wig) and to conform generally to the hair lengths, most commonly suitable for fashion haircutting and hairstyling operations, and to the features of the human head and shoulders. The principal part has two sets of lines with their respective two sets of identifying designations. Means are secured along the whole length of the upper edge of the principal part for selectively and adjustably securing the principal part at any of a plurality of parting lines on the head of a user, whose hair is to be cut and shaped at a plurality of different levels on the head. The device thus separates the hair above and below the parting line, at which it is secured, while the first and second sets of lines, with their respective designations, serve to guide the hairdresser/hairdesigner in cutting and shaping the layer of strands of hair above the parting line when the hair is draped over the surface of the device, to permit measuring of the hair to be cut and shaped and, as it is being cut and shaped, to insure symmetry, accuracy and precision at each strand of hair during the cutting and shaping operation.

Disclosed a method of using the device in fashion haircutting and hairstyling operations.

Disclosed a method of recording and re-creating and fashion haircut with the use of the invented device.

Disclosed a method of fashion hairstyling with the use of the invented device.

2 Claims, 9 Drawing Figures

CUT AND STYLE—DEVICE FOR FASHION HAIRCUTTING-HAIRSHAPING AND HAIRSTYLING

FIELD OF INVENTION

The present invention relates to beauty supplies and particularly to the hairdressers' and hair-designers's tools.

It is a device designed for professional use during the haircutting-hairshaping and hairstyling procedures in beauty parlours, wig manufacturing businesses, and, with some basic related skills, may also be used domestically. It is designed to enable the hairdresser/hairdesigner to fulfill precisely and effectively any predetermined haircut (obviously, within the limits of the given length of hair) by enabling to attain any planned or desired length of hair at each and every point of the head of a person or at the surface of a wig (being put on a head of a person or on a dummy for wigs). (Further, in the Specification and in the Claims, where references are made to "head", "hair", "haircutting-hairshaping", "hairstyling", "person", or "client", or "user", the words are intended to encompass not only human heads and human hair but also wigs placed on human heads or dummy heads.) With the use of the device any fashion haircut also may be recorded, if it is desired for re-creation purposes, teaching purposes, etc.

DISCUSSION OF PRIOR ART

As is widely known, fashion haircutting-hairshaping procedure encompasses actions of cutting strands of hair in special order and of special length as to achieve a planned design, and, in ultimate goal, to create a planned coiffure.

And even for the highly skilled hairdressers and hairdesigners the invented device will serve as a powerful tool and increase their creative abilities, because the use of said device not only saves time and makes it possible to accomplish, record and re-create in a very precise way most complicated hairdesigns, but provides a visual graphic aid for various modifications.

OBJECTS

Accordingly, the general object of the present invention is to provide hairdressers and hairdesigners with a reliable and efficient device for use during the haircutting-hairshaping and hairstyling procedures.

The more particular objects of the present invention are: to alleviate the work of hairdressers and hairdesigners and to increase its quality. That is, to help to achieve precisely and effectively any predetermined fashion haircut with a comparatively small amount of partings of the hair and comparatively little tampering with the hair by providing means that are supposed to be applied consecutively at various levels of the head of a person, whose hair is being cut and shaped, and supposed to serve, at the same time, for the following purposes: for gradual and secure separation of the layers of strands of hair—to be cut—from the rest of the hair, as a light visual background and as a visual graphic aid, measuring and recording tool, and a stencil for use during the cutting and shaping of said layers of strands.

The function of separating the layers of strands of hair may be successfully applied in various patterns of hairstyling, requiring consecutive separation of the layers of strands of hair to be set on rollers, curled with an iron or pins or styled with a brush and blowdryer. Such application will result in increased efficiency of hairdressers'/hairdesigners'work and in the greater effectiveness of the coiffures.

The other advantages of the invention:

It is considerably simple device, it does not require a big investment to produce it and therefore it will be inexpensive (the cost price is supposed to be 80–90¢ for a piece).

The use of the invented device alleviates the labor of hairdresser/hairdesigner and saves time.

It is also convenient for the customer for the same reason.

The haircutting-hairshaping and hairstyling with the use of the invented device is healthier for the hair of a client: it does not require so much tampering with the hair (that is fastening, unfastening and subparting each of the multiple small strands, as has been shown in the enclosed published prior art).

The device is reliable and will have an extremely large market, because, with some basic related skills, the device may also be used domestically.

High quality fashion haircutting-hairshaping and hairstyling with the use of the invented device may be done not only by top skilled hairdressers, that is not only in the expensive beauty parlours. Even an average skilled hairdresser with the use of the invented device, will be able to achieve high quality results.

The device is ornamentally designed, has a good appearance, and it is durable, lightweight, compact in packaging and convenient in distribution.

One of the important advantages of the present invention, that it makes possible to standardize the various patterns of hairdesigns, so vaguely determinable and discernible at present (because, as the enclosed published prior art shows, and as it is commonly known, the fashion haircutting is done at present essentially by estimation by sight, or freehand).

For example, the hairdesigner, using the invented device is being aware, that a certainly named coiffure requires certain lengths of strands of hair at the certain levels and areas of the head of a person, for instance: 7" at the crown; 1½" on the nape; 5" on the forehead area and 4" on each side. The use of the invented device makes it possible not only to achieve precisely the desired length of strands of hair on the certain given areas and levels of the head and to blend said strands of hair of various lengths into each other efficiently, that is gradually and securely, evenly and symmetrically, but also to put on record the haircut and to re-create it precisely if or when it is desired.

These and other detailed objects and features of the present invention will become more apparent from consideration of the drawings and ensuing description thereof.

(All the drawings described in details in the next section: "Detailed Description of Invention, Operation and Instructions.")

DETAILED DESCRIPTION OF THE INVENTION, OPERATION AND INSTRUCTIONS

The invented device for fashion haircutting-hairshaping and hairstyling (FIG. 1) comprises a principal part of the device (a) and a holder (that is an elastic/rubber band)—(b) being sewn to the whole length of the upper edge (c) of the principal part of the device and thus becoming an integral part of it.

The principal part of the invented device (FIG. 2) is ornamentally designed that its upper edge (c) fits and can be fastened in circumference on any level of a human head. When placed in such working position the principal part takes shape similar to the shape of a hollow truncated cone (with part of it removed for exposure of the user's face),—and conforms to the hair lengths, most commonly suitable for fashion haircutting and hairstyling operations, and to features of the human head and shoulders.

The size of the principal part is 20½ (54.7 cm) by 20" (50.8 cm) in the widest and longest parts consequently.

The material for use in forming the principal part (a) is preferably soft, smooth, plastic, elastic, flexible, transparent, water impervious and strong enough to endure sewing, because the holder (that is the elastic/rubber band)—(b) is supposed to be sewn to the whole length of the upper edge (c) of the principal part (a); the preferred material for the principal part is a sheet of plastic vinyl.

Regarding the purposed functions of the principal part (a): to provide means for secure separation of the layers of strands of hair—to be cut and shaped—from the rest of the hair, to provide a visual light background, when cutting and shaping strands of hair, and to serve as a visual graphic aid, measuring and recording tool, and a stencil during the haircutting and hairshaping procedures,—the principal part (a) bears a two-color impression of specially arranged ruling.

When the device will be produced, the straight radial lines and their respective capital letters,—that is the first set of lines with their respective designations,—will be displayed in the same one color; the curved parallel lines and their respective numbers,—that is the second set of lines with their respective designations,—will be displayed in a different color.

Figure 2:
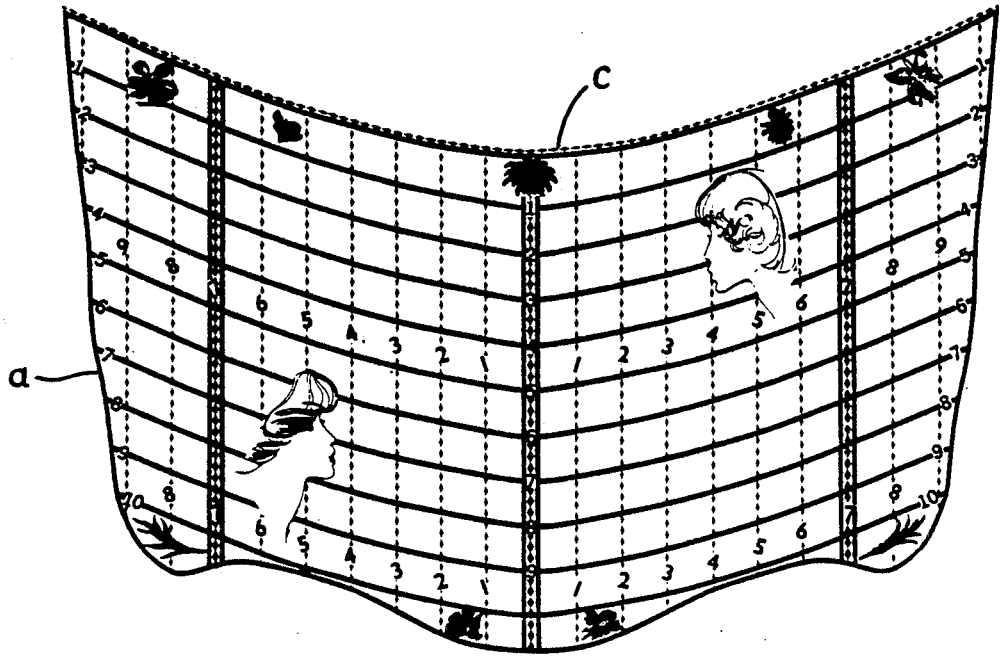
FIG. 2 is a plan view of the principal part of the invented device, diminished to 32%.

As it is shown clearly on FIG. 2, all the lines are designated in sequential order several times repeatedly, as to allow the hairdresser/hairdesigner to see the designations conveniently from each point of view, while working.

The straight radial lines (said first set of lines), designated with their respective capital letters in alphabetical order, starting from the centerline (A) (said centerline, when the device is placed in the working position, supposed to coincide with the center of the back of the head and maintain a vertical direction) and progressing to each of the edges of said principal part the way that each of said radial lines and its respective designations (except of said centerline) has its duplicate on the counterpart side of said principal part. Said straight radial lines are crossing the upper edge (c) 1" (2.54 cm) apart from each other, from the center being established at a distance 6¼" (16 cm) from the middle of the upper edge (c), and with their respective capital letters are meant for the purpose of symmetrical guidance (while the layers of strands are being cut and shaped).

The curved parallel lines (said second set of lines) are numbered in the increasing order from top to bottom (each figure stands for an equal amount of inches, or ×2.54 cm).

The hatched spaces (d) indicate the extra areas of plastic vinyl material to be bent under the upper narrow ends of the device to strengthen those two areas, where the fasteners or snapclips will be attached. The little squares (e) on both upper narrow ends of the device and on the extra areas (d) are outlining the positions of the self-fastening strips or snapclips—whichever will be used for fastening the device around the head.

The present embodiment of the invented device utilizes the overlapping method of said fastening, that is four self-fastening strips will be attached respectively: to the right side, that is to the upper surface, of the right narrow end of the device, and to the reverse side of the left narrow end of the device.

The arrangement of the ruling and designations is destined to provide a visual graphic aid and a measuring tool for the hairdresser/hairdesigner during the haircutting-hairshaping procedures, to alleviate his work and to ensure symmetry, accuracy and effectiveness of the haircut.

The parallel curved lines of the ruling may serve also as a stencil during the haircutting and hairshaping procedures or/and may just serve as a measuring tool; that is the hairdresser/hairdesigner, when cutting strands of hair, may follow the curved lines of the impression, if it is corresponding with his planned design, or may use the ruling as just a measuring tool and guide of symmetry to achieve the planned design.

The holder (b)—(FIG. 1) is a narrow (about ¼", or 5–6 mm) elastic/rubber band, permanently attached (by sewing) to the whole length of the upper edge (c) of the principal part of the device (a) (FIG. 2).

Figure 1:
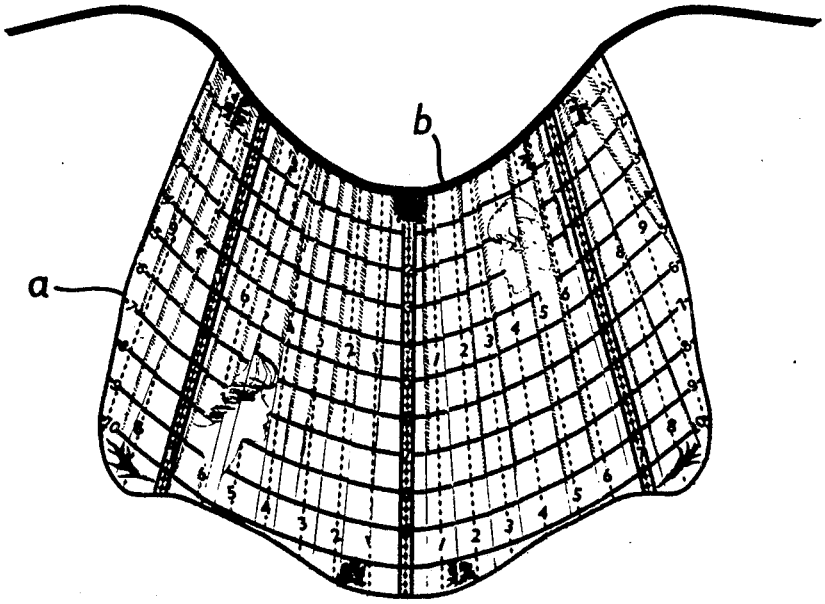
FIG. 1 is a perspective view of the invented device, diminished to 11.5%.

When sewn to the principal part of the device, said holder (that is the elastic/rubber band) is being slightly stretched, and that is why the upper edge of the principal part of the device looks slightly gathered on FIG. 1. But when the device is put on the head of a client, with said holder (an integral part of the whole upper edge of the principal part of the device) being placed at a preliminary established parting line on/around any level of the head and fastened in the middle front of the head, said holder surrounds the head of a user—beneath the layer of strands—to be cut and shaped—and takes the shape generally similar to the shape of the upper perimeter of a hanging downwardly hollow truncated cone, and stretches conformably, and holds securely the principal part of the device (i.e. the "hollow truncated cone with part of it removed") (FIGS. 4B, C, D).

As an illustration of the principle and method of operation of the invented device let us figuratively imagine a perfect haircut—a realization of a certain planned design,—as a multiple series of precise, symmetrically drawn and evenly separated from each other, curved "cutting lines" "drawn" with the scissors in "space", that is above or out of the surface of the head, in the "orbits", that are generally parallel to the general outline of the natural hairline. The distances, at which each and every point of the "cutting line" was "drawn"—from the respective points on the surface of the head,—stand for (or equal to) the lengths of hair at said points of said surface.

How to achieve practically the desired length of the hair at each and every point of the surface of the head? In other words, how to achieve the desired shape of a planned haircut, since it is a main condition for achieving the ultimate goal of hairdressers'/hairdesigners' work—creation of the desired coiffure?

In search of a practical answer to this question, it is taken into consideration the simple fact, that it is comparatively easier to draw a precise and symmetrical line on the surface (in our case it is a parting line on the surface of the head, where the symmetry and accuracy may be achieved considering as guiding points the natural features of the head), than to "draw" a precise and symmetrical line in "space" (in our case it is a "cutting line" above, or out of the surface of the head).

Suppose that all the hair of our imaginary client is divided in layers of strands with symmetrically made parting lines around the head (FIG. 3A), which are parallel oriented to the natural hairline and equally separated from each other at the distance approximately ½" (1.3 cm), and that to any and each of said parting lines (the dotted lines on FIG. 3A) it would be possible by any means to "attach" securely a "surface", that: (1) will securely separate each of the parted layers of strands from the others, (2) will provide a visual light convenient background, when said strands will be cut and shaped, and (3) will bear a specially arranged impression, which will serve as a visual graphic aid and measuring tool for each and every strand of hair to be cut above said surface.

So, the practical answer to that question is embodied in the invented device.

Cut & style separates the hair above and below the parting line at which it is secured, while the centerline and the first and second sets of lines and designations serve to guide the hairdresser/hairdesigner in cutting and shaping the hair above the parting line, to permit measuring of the hair to be cut and, as it is being cut, to insure symmetry, accuracy and precision at each layer of hair during the cutting and shaping operation, while the hair beneath the device, that is within the "truncated cone", is visible throught the sheet for comparison with the hair being cut, when it is draped on and over the upper surface of the device.

For practical application of the device, the distances between the parting lines, separating the layers of strands, and consequently the amount of reiterative applications of the device for separation of said layers of strands and for measuring guidance in cutting and shaping of said strands obviously will vary with regard to the chosen haircut. But it is assumed, that 2–3 reiterative gradual partings in a manner described in the instructions and with the subsequent use of the device, is sufficient to accomplish successfully any planned fashion haircut.

The application of the invented device for fashion hairsetting and hairstyling is based on the function of the device as means for consecutive separation of the layers of strands of hair to be set on rollers, styled with a brush and blowdryer and curled with an iron or pins.

The further details of the operation of the invented device are set forth below, in the "Instructions", which in concise version are supposed to accompany that article of manufacture when it will be produced.

INSTRUCTIONS

How to Use "Cut & Style"

"Cut & Style" is a device for fashion haircutting-hairshaping and hairstyling. It is designed for professional use in beauty parlours and wig manufacturing businesses; with some basic related skills, the device may also be used at home.

The use of "Cut & Style" provides the opportunity to fulfill precisely and effectively any predetermined haircut (obviously, within the limits of the given length of hair), which is necessary for creating various high fashion coiffures, and also to record and re-create the haircut.

"Cut & Style" is designed to be used for consecutive separation of the hair in layers of strands on/around the head of a person or a wig (being put on a person's head or on a dummy for wigs).

"Cut & Style" also makes it possible to cut each of the strands above the surface of the device to a certain desired length and to blend the strands in length symmetrically by utilizing the impression on the surface of the device: the curved lines, with their respective numbers, representing the distances from the upper edge of the device (in inches),—for cutting the strands to certain lengths; the radial lines, with their respective capital letters,—for guiding the symmetry of the "cutting lines".

I. How to Use "Cut & Style" For Haircutting-Hairshaping

Figure 3:
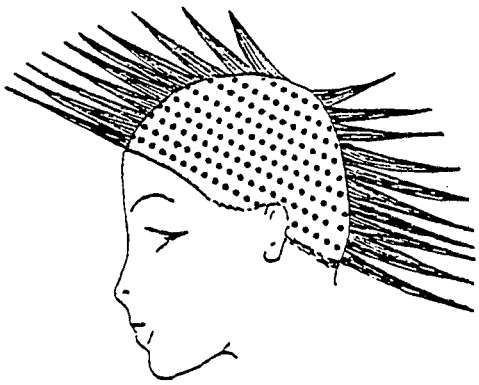
FIGS. 3A, B are schematic representation of the idea and method of using the invented device for haircutting-hairshaping and for recording of this procedure.

"Cut & Style" may be used for haircutting-hairshaping successfully in many different ways. Here is one that is recommended:

Apply "Cut & Style" beneath the layers of hair to be cut and shaped around the head, as is shown schematically on FIG. 3B with the dotted lines (I–III). The dotted lines indicate: I—the general outline of the natural hairline; II and III—what we will call the "middle" and "upper" parting lines.

It is important that the "upper" and "middle" parting lines be established as generally parallel to the natural hairline and equally separated from each other and accordingly from the crown (IV) and the natural hairline (I). Obviously, to establish the locations of said parting lines, the average distance from the crown to the natural hairline has to be divided by 3.

Here is the recommended procedure for a fashion haircut with "Cut & Style":

1. For better results, wet the hair. With regard to the planned coiffure, imaginarily establish a plan for fulfilling the haircut. Presumably, the planned coiffure calls for starting the haircutting-hairshaping procedure from the top of the head.

Accordingly, establish the length of strands of hair on the crown area (IV, FIG. 3B) by cutting these strands to the desired length. For that purpose no parting is necessary, just pick a few strands on the crown area (which is considered to be approximately 1" in diameter) and, by holding "Cut & Style" beneath these strands, measure off the desired length of these strands and cut them conformably to that measurement. 2. Establish and make one accurate, symmetrical and generally parallel to the natural hairline parting line around the head, as shown on FIG. 3B(III) and FIG. 4A with a dotted line, then gather the layer of strands of hair above the parting line and fasten the strands with a clipper.

Put the device on the head of your client so that the upper edge of the device, where the holder (that is the elastic/rubber band)-(b) is located, lays exactly on the parting line around the head (shown on FIG. 4A with a dotted line), and fasten the narrow ends of the device in the middle front of the head (FIG. 4B).

3. Unfasten the strands of hair, place them down on the surface of the device (a—on FIG. 4B, C, D) and comb slightly with the edges of the comb, placing and draping the wet hair evenly around (FIG. 4C). While combing be careful not to pull out the hairstrands, that are below the parting line and beneath the device. 4. Establish the lengths of the strands of the layer of hair by cutting these strands, starting in the middle of the back of the head, toward the left front and then toward the right front (FIG. 4C). Obviously, the feasible cutting lines (that is the broken lines 1, 2, 3, shown on FIG. 4C) may lie higher or lower, than is shown on FIG. 4C, and may have infinite variety of directions, depending on the planned haircut.

When cutting the layer of strands of hair to the desired lengths, utilize the impression on the surface of the device as a graphic aid and as a measuring and recording tool (whenever recording is desired).

After cutting the layer of strands around the head to the desired lengths, shape these strands (also working around the head) so that these strands will be blended in length with those already cut (on the crown area).

5. Depending on the planned haircut, the procedures described above (parting, adjusting the device, cutting and shaping), may have to be repeated on consecutively different levels of the head (FIG. 3B), in any order, and as many times, as the planned haircut requires; 3 successive applications of "Cut & Style", in a manner, described in this Instructions, are usually sufficient to accomplish successfully any planned fashion haircut, to record, and also to re-create the haircut subsequently, if desired.

When proceeding with the haircut from one layer to another, the strands of hair should be cut and shaped to conform (that is, to blend and merge) in lengths with the respective adjacent strands of the previously cut and shaped layer.

It should be also emphasized, that when proceeding with the haircut from one layer to another—before adjusting the device to a new parting line—all the hair above that new parting line should be securely gathered and fastened.

Accordingly, if the new parting line is to be below the one previously made (in case the haircut was started with the layer of strands on the top of the head, as shown on FIGS. 4A, B, C, and is being continued downward):

(a) after cutting and shaping the layer of strands to the desired lengths, gather and fasten the same strands once again above the parting line;

(b) remove the device, establish and make a new parting line (below the previous one), add the new layer of strands to those already gathered and fastened, and fasten all the strands together;

(c) then adjust the device to the newly made parting line and continue by unfastening, draping, cutting and shaping of that layer of strands.

Figure 4A:
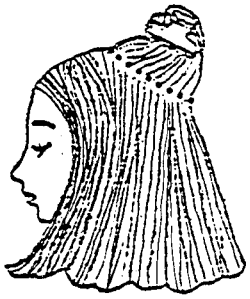
FIGS. 4A, B, C, D are illustrations of the few key positions out of multiple feasible positions of the invented device on the head of a client during the haircutting-hairshaping procedures and an illustration of the mode of cutting and shaping strands of hair, and recording the procedures while using the device.
Figure 4B:
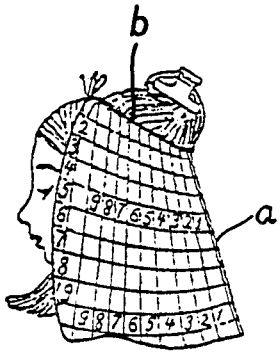
Figure 4C:
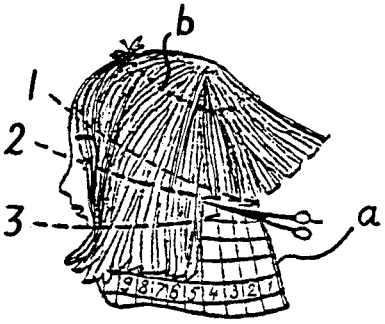
Figure 4D:
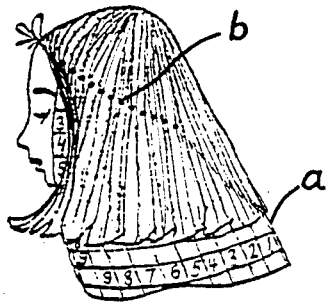

If the new parting line is to be made above the previous one (in case the haircut was started from the hair ends, as shown on FIG. 4D, and is being continued upward):

(a) establish and make the new parting line (above);

(b) gather and fasten the layer of strands of hair above said parting line (the layer of strands of hair, remaining on the surface of the device, may be shaped to a more precise degree, following the chosen direction of the cutting line);

(c) then remove the device and adjust it to the newly made parting line, and continue by unfastening, draping, cutting and shaping of that layer of strands.

6. When cutting and shaping hair ends (FIG. 4D): the upper edge, with the holder (b), is placed following the general outline of the natural hairline around the head and fastened; all the hair is on the surface of the device (a), and the hair ends should be cut and shaped in accordance with the planned design, while using the arrangement of the lines, letters and figures on the surface of the device as a tool for precision and symmetry and as a measuring and recording tool, when recording is desired.

7. After the haircut is completed and the device is finally removed, do the finishing touch-trimming, blending the hair in length, thinning of the hair, if required, and trim the neckline, if necessary.

8. If the haircut is done in the traditional way, "Cut & Style" will serve as a tool for checking, correcting and perfecting the quality of the haircut, and also for recording the haircut, when desired.

9. Care must be taken not to cut the surface of the device while performing the haircut.

10. For hygienic purposes, the device has to be thoroughly washed with soap and rinsed in warm water each time after it has been used on a client.

II. How to Use "Cut & Style" For Styling The Hair

"Cut & Style" may also be successfully applied in hairstyling operations, when setting the hair on rollers, styling the hair with a brush and blowdryer and curling the hair with an iron or pins, when the planned design requires, for example, to set the hair in evenly and symmetrically shaped rows around the head, or to distinctly separate the layers of hair to be curled or wound in opposite directions, or to protect the hair beneath the surface of the device from drying while the layers of strands of hair above the parting line are being styled with a brush and blowdryer. Obviously, when using the device for separation of the layers of strands to be set in various patterns, the distances between the adjacent parting lines should be equal to or larger than (but not less than) the diameter of the roller, or iron curler, or pincurl, whatever is used.

The application of the device in hairsetting-hairstyling makes for emphasising the stylelines, enhances the effectiveness of the coiffures and the efficiency of the hairdresser's/hairdesigner's work.

Figure 5A:
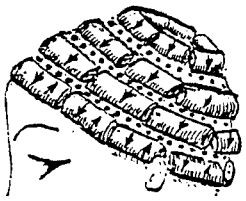
FIGS. 5A, B are illustrations of two out of multiple feasible hairstyling patterns for which the present device may be successfully applied.
Figure 5B:
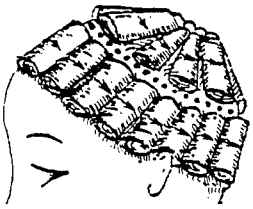

Two out of the many setting patterns for which "Cut & Style" may be successfully applied are illustrated on FIG. 5A ("Artichoke") and FIG. 5B ("Circles"). (The dotted lines indicate the parting lines, where the device was applied for the consecutive separation of the layers of hair to be set on rollers.)

III. How To Use "Cut & Style" For Recording and Re-creating A Haircut

Taking into consideration that the heads of adult persons do not vary in sizes significantly and assuming that "Cut & Style" was applied as recommended in Part I of these Instructions, any fashion haircut can be recorded, step by step, and subsequently re-created in a precise manner not only for the client, whose haircut was recorded, but also for other clients.

For instance, the steps of the haircutting procedure, shown in FIG. 4D, will be recorded as follows: "Natural Hairline: A—9; B—8¼; C—7¾; D—7¾; E—7¼; F—7". This means that the device is located with its holder (b) on the general outline of the natural hairline and the lengths of hair on that level around the head, according to the designations on the surface of the device, are: in the middle of the back of the head (the centerline A)—9 inches, and so forth.

The steps shown, for instance, on FIG. 4C should be recorded: "Upper Parting Line: A—5", and so forth, depending on which one out of the infinite varieties of directions will be followed, which in turn depends on the planned hairdesign.

Since the device is designed to keep the client's face exposed, to record the lengths of the hair on any level of the middle front part of the head, that is beyond the surface of the device, the correspoding ruling of the device should be imaginarily extended. Thus, the record of the steps shown, for instance, on FIG. 4C may be concluded as follows: . . . "H—5; Middle Front—5" (or any number of inches, up to 10, in accordance with the planned haircut and the ruling of "Cut & Style").

To record the type of haircut shown schematically on FIG. 3B, the length of the hair on the crown area (IV) should be measured and recorded as well as the lengths of the hair along the parting lines (II, III) and the natural hairline (I).

When subsequently re-creating, for instance, that type of haircut, the strands of hair on the crown area (IV) should be cut to the recorded length as well as the hair along the parting lines (II, III) and the natural hairline (I), and to achieve the gradual, smooth outline of that haircut, the hair should be blended in length around the head not only along the parting lines (II, III) and the natural hairline (I), but also within the natural hairline (I) and the crown area (IV), as it is described in Part I of these Instructions.

If the haircut is asymmetrical, the designations "Right" and "Left" should be used for recording the steps of the haircut on the right and left sides of the head.

The recording of the haircut (a special notebook for preserving of such records is recommended) may be done simultaneously while cutting and shaping the layers of strands of hair or afterward, when the haircut is completed.

"Cut & Style" represents a new, progressive method in fashion hairdesign. One of the important advantages of using the device is that "Cut & Style" makes it possible to standardize the numerous patterns of hairdesigns, so vaguely determinable and discernible at present (because, as it is commonly known, fashion haircutting is now done essentially "freehand", or by sight).

The hairdresser/hairdesigner, using "Cut & Style", can attain precisely the desired various lengths of strands of hair on certain given areas and levels of the head, blend these various lengths into one another gradually, evenly and symmetrically, and then record the procedure exactly, so that it will be possible to identify the haircut and to re-create it precisely, when desired.

These Instructions do not exhaust all the possibilities and advantages that the use of "Cut & Style" provides. The more skilled the hairdresser is, the more benefit he will derive from using the device, because the use of "Cut & Style" not only saves time and makes it possible to accomplish, record and re-create in a very precise way the most complicated coiffures, but provides a visual graphic aid for various new creations in fashion hairdesign.

It is impossible to enumerate all the varieties of opportunities, that the use of the invented device provides in fashion haircutting and hairstyling.

While the above description contains many specificities, this should not be construed as limitations on the scope of the invention, but rather as an exemplification of one preferred embodiment thereof. Some other variations are possible, for example: the size of the device may be changed to conform to a child's head or to longer hair; the arrangement of the impressed guidelines can be made in various ways, the numeration can be presented in the metrical system, etc.

It is recognized, that various modifications and changes may be made in the present invention without departing from the spirit thereof.

I claim:

1. A device for use in fashion haircutting and hairshaping to enable a hairdresser or hairdesigner to precisely and effectively create, recreate or record a predetermined haircut of any desired hair lengths at each and every point of a head or wig, said device being adapted to be selectively disposed at a plurality of positions on the head of the person whose hair or wig is to be cut and shaped, and comprises, (a) a principal part consisting of a sheet of substantially flat, smooth, thin, limply flexible, transparent and water-impervious material having a concavely arcuate upper edge adapted to be placed and fit in completely surrounding and continuously closely fitting engagement with the front, back and sides of a user's head at any of a plurality of circumferential positions located at various preselected parting lines on any level on the head, a lower edge spaced from said upper edge by dimensions varying along its length selected to conform generally to the hair lengths and shoulders and a pair of opposed side edges connecting said upper and lower edges, said sheet being shaped and dimensioned to assume a generally truncated-conical configuration, depending from said upper edge in surrounding relation to the front, sides and back of the user's head for a distance sufficient to underlie a substantial range of side and back hair lengths when said upper edge is positioned on the head as aforesaid, said sheet having thereon a first set of indicia consisting of a plurality of straight lines for guiding the symmetry of a haircut while the layers of strands of hair on any preselected parting line, on any level of the user's head, are being cut and shaped, said straight lines extending generally radially from said upper edge toward said lower edge and being distributed over the entire area of the sheet relative to a common center and having a predetermined angular spacing between them, and a second set of indicia consisting of a plurality of curved arcuate generally parallel lines for guiding the cutting and shaping of layers of strands of hair on a head to any predetermined length, said plurality of curved arcuate lines conforming in curvature generally to the curvature of said upper edge and extending transversely to said straight lines entirely across the sheet, said arcuate curved lines being distributed over the entire area of the sheet with substantially equidistant spacing of predetermined extent between them and each intersecting said straight lines such that each arcuate line has a multiplicity of angularly spaced intersections with the straight lines, a first set of identifying designations consisting of designations respectively associated with said straight radial lines, and a second set of designations consisting of designations respectively associated with said curved arcuate lines, whereby each of said lines is identified to enable the hairdresser/hairdesigner to obtain any preselected hair length at each and every parting level at which the device is placed with said straight lines serving to guide the symmetry of the haircut relative to their center while the layers of strands of hair on any level of the head are being cut and shaped, and said curved arcuate lines serving to allow the hairdresser/hairdesigner to cut and shape said layers of strands of hair on the head to any predetermined length (b) means permanently attached to and along the whole length of said upper edge of said sheet for selectively and adjustably securing said upper edge at any selected one of a plurality of parting lines on the head of a user whose hair is to be cut and shaped at a plurality of different levels on said head, with said upper edge of said sheet being engaged in an arcuate curved configuration around the head, and with the sheet curving around the head below said upper edge and below said one parting line on the head at which it is secured, and hanging downwardly therefrom in a generally truncated-conical configuration as aforesaid to cover the hair below said one parting line, while leaving the user's face exposed, whereby said sheet in said truncated-conical configuration separates the hair above and below said one parting line, at which it is secured, while said straight and arcuate curved lines serve to guide the cutting and shaping of the layer of strands of hair above said parting line, when said layer of strands is draped over the surface of said sheet to permit measuring of the strands to be cut and shaped and, as they are being cut and shaped, to insure symmetry, accuracy and precision of the cutting and shaping operation, while the hair beneath said sheet, within said truncated-conical configuration, is visible through said sheet for comparison with the layer of strands being cut and shaped when it is draped on and over said lines on said sheet.

2. A device as defined in claim 1, wherein (i) said straight and arcuate lines are respectively of different colors;

(ii) one of said straight lines is a center line extending from said upper edge to said lower edge, others of said straight lines being respectively disposed on opposite sides of said center line, (iii) said first set of designations are letters in alphabetical order, including a first letter for said central line and other letters for other lines with the same letter applied to lines spaced equiangularly from the center line, (iv) said second set of designations are numerals in successive order, each repeated several times along the length of its associated arcuate line and each representing a length measurement; and (v) said securing means comprises elastic band means permanently attached to and along the whole length of said upper edge.

* * * * *

UNITED STATES PATENT AND TRADEMARK OFFICE

CERTIFICATE OF CORRECTION

PATENT NO. : 4,619,280

DATED : October 28, 1986

INVENTOR(S) : Ludmila Yampolskaya

It is certified that error appears in the above-identified patent and that said Letters Patent is hereby corrected as shown below:

The title page showing the illustrative figure should be deleted to appear as per attached title page.

In the drawing the two (2) sheets of drawing should be deleted to be replaced with two (2) sheets of drawing as shown on the attached sheets.

On the title page, right column, 5th line from the bottom, "re-creating and" should read -- re-creating any --.

On the title page, 1st line from the bottom, "9 Drawing Figures" should read -- 10 Drawing Figures --.

United States Patent [19]

Yampolskaya

[11] Patent Number: 4,619,280

[45] Date of Patent: Oct. 28, 1986

[54] CUT AND STYLE—DEVICE FOR FASHION HAIRCUTTING-HAIRSHAPING AND HAIRSTYLING

[76] Inventor: Ludmila Yampolskaya, 1-Bogardus Pl., Ap 5M, New York, N.Y. 10040

[21] Appl. No.: 474,975

[22] Filed: Mar. 14, 1983

[51] Int. Cl.[4] ..... A45D 24/36

[52] U.S. Cl. ..... 132/45 R

[58] Field of Search ..... 152/45 R

[56] References Cited

U.S. PATENT DOCUMENTS

| | | | |
|---|---|---|---|
| 2,618,274 | 11/1952 | Nell | 132/9 |
| 2,808,840 | 10/1957 | DeSantis | 132/45 R |
| 2,818,074 | 12/1957 | Mach | 132/9 |
| 2,919,702 | 1/1960 | Olivo | 132/45 R |
| 2,936,767 | 5/1960 | McDonough | 132/45 R |
| 3,347,248 | 10/1967 | Weitzner | 132/40 |
| 3,935,870 | 2/1976 | Wall | 132/45 R |

*Primary Examiner*—Gregory E. McNeill
*Attorney, Agent, or Firm*—Pasquale A. Razzano

[57] ABSTRACT

A device is disclosed for use in fashion haircutting and hairshaping to enable a hairdresser or hairdesigner to precisely and effectively fulfill and/or record and/or re-create a predetermined haircut of any desired hair length at each and every point of a head or wig (obviously, within the limits of the given length of hair). The device includes a principal part—a sheet of smooth, thin, flexible, transparent and water impervious material—adapted to be placed and fit in any of a plurality of circumferential positions at various preselected levels on human head (or a wig) and to conform generally to the hair lengths, most commonly suitable for fashion haircutting and hairstyling operations, and to the features of the human head and shoulders. The principal part has two sets of lines with their respective two sets of identifying designations. Means are secured along the whole length of the upper edge of the principal part for selectively and adjustably securing the principal part at any of a plurality of parting lines on the head of a user, whose hair is to be cut and shaped at a plurality of different levels on the head. The device thus separates the hair above and below the parting line, at which it is secured, while the first and second sets of lines, with their respective designations, serve to guide the hairdresser/hairdesigner in cutting and shaping the layer of strands of hair above the parting line when the hair is draped over the surface of the device, to permit measuring of the hair to be cut and shaped and, as it is being cut and shaped, to insure symmetry, accuracy and precision at each strand of hair during the cutting and shaping operation.

Disclosed a method of using the device in fashion haircutting and hairstyling operations.

Disclosed a method of recording and re-creating and fashion haircut with the use of the invented device.

Disclosed a method of fashion hairstyling with the use of the invented device.

2 Claims, 9 Drawing Figures

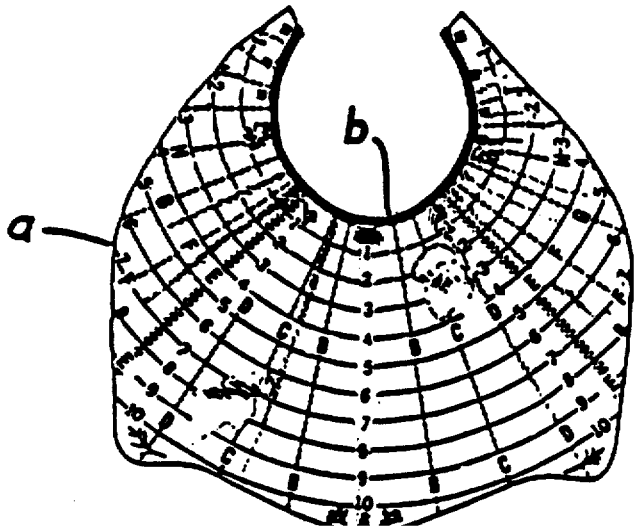

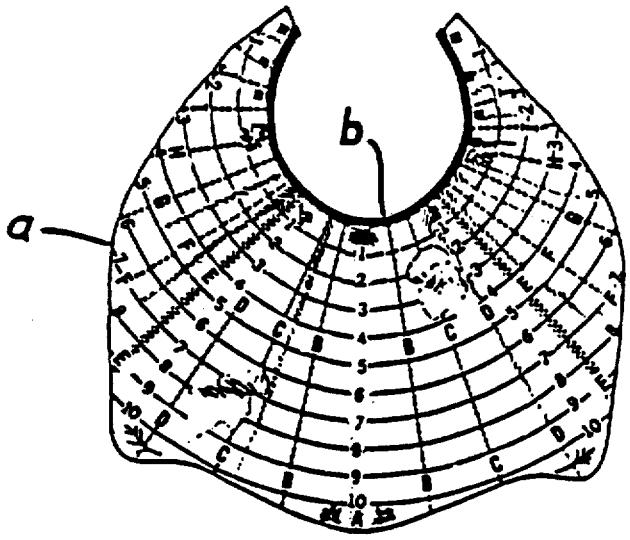
FIG. 1
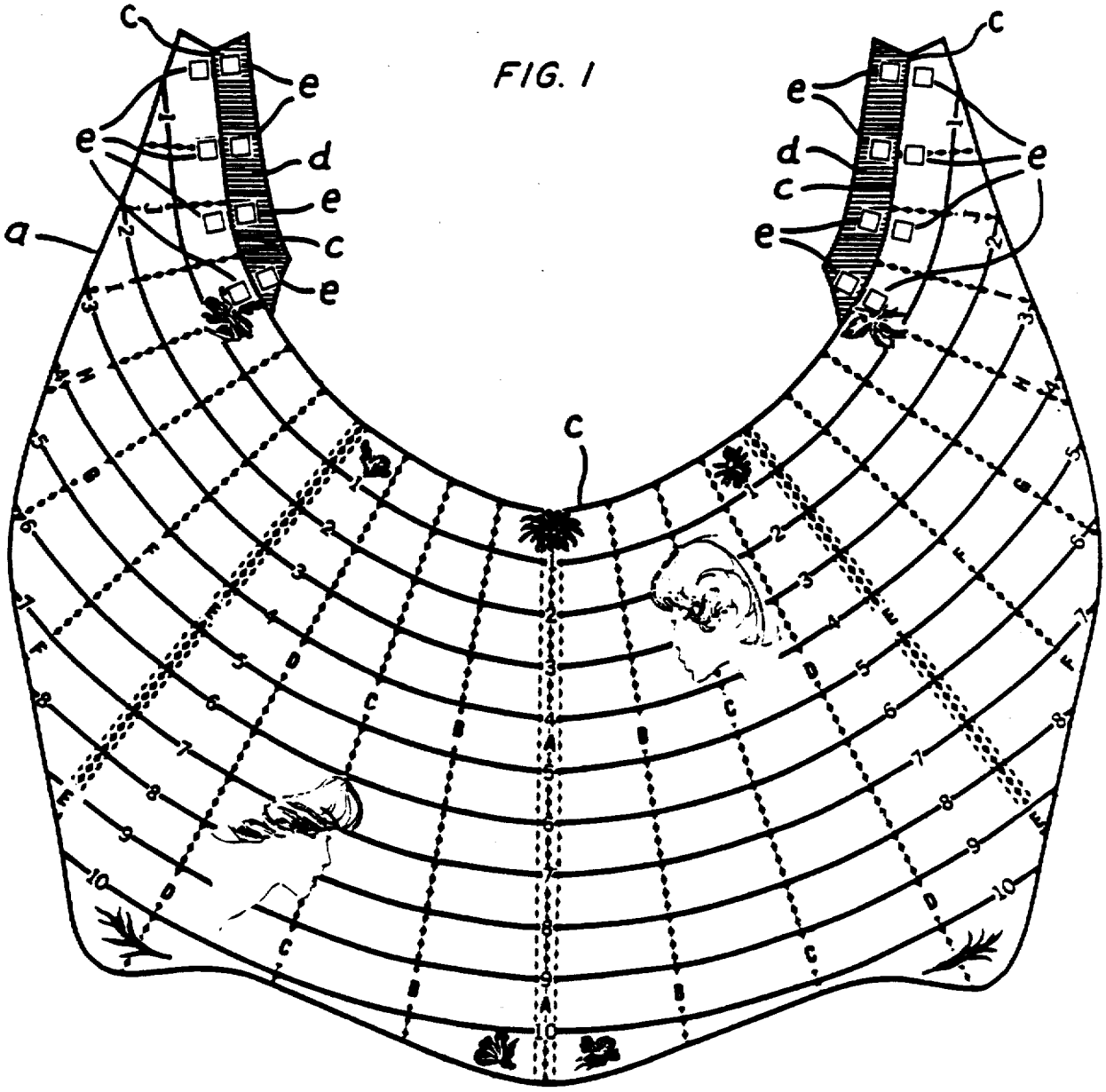

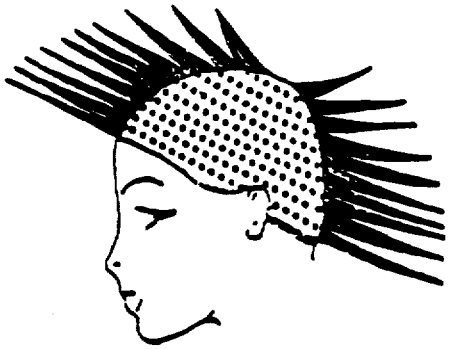
FIG. 3A
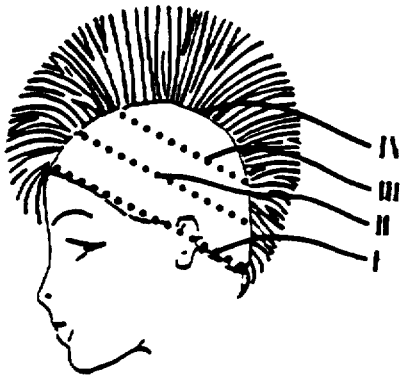
FIG. 3B
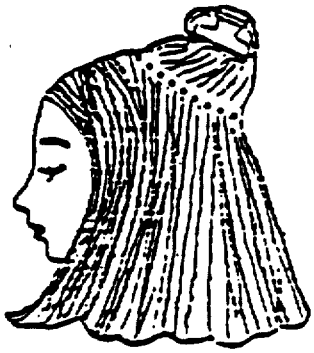
FIG. 4A
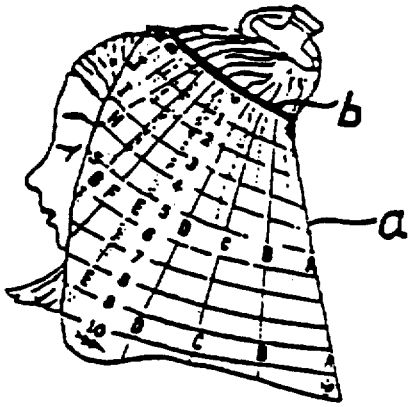
FIG. 4B
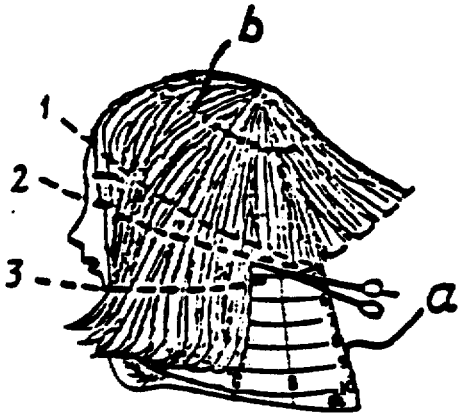
FIG. 4C
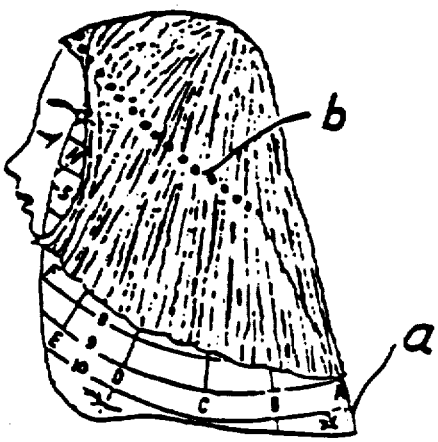
FIG. 4D
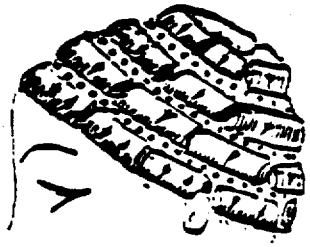
FIG. 5A
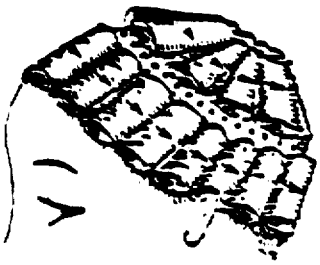

UNITED STATES PATENT AND TRADEMARK OFFICE

CERTIFICATE OF CORRECTION

PATENT NO. : 4,619,280

DATED : October 28, 1986

INVENTOR(S) : Ludmila Yampolskaya

It is certified that error appears in the above-identified patent and that said Letters Patent is hereby corrected as shown below:

Column 1, between lines 35 and 36 insert:

-- As an illustration of the methods and tools used in the related field presently, some copies of prior art are enclosed.

Page 1—is a clipping from a recently issued edition of one of the popular weekly newspapers in the U.S.A. the "National Enquirer". It indicates clearly that even highly skilled in the related field people, like the famous hairdesigner, who is showing his work on the pointed out picture, with his client being suspended upside down, have not found yet any better way to do a precise haircut, it also indicates to what extent even highly skilled hairdressers and hairdesigners are in need of a reliable, convenient tool for use to achieve precision and efficiency in their work.

Enclosed are some copies of chosen at random pages from special magazines for hairdressers and hairdesigners "Pivot Point International, 5 Popular Haircuts" ("Prior Art", pp.2-19). It is quite obvious how the high fashion haircutting-hairshaping It is certified that error appears in the above-identified patent and that said Letters Patent is hereby corrected as shown below:

procedures, depicted on the enclosed copies, are complicated and time consuming. It requires dividing the hair into multiple little strands, then having each of the multiple parted and fastened strands, in turn, unfastened and subparted a few times.

And the main "tools" in possession of the hairdresser/hairdesigner in achieving the precise haircut and in fulfilling his planned design in estimation by sight and his artistic "flair", which are the qualities of top skilled hairdesigners and artists.

Pages 20-29 of "Prior Art"-are also copies of some pages from special magazines for hairdressers and hairdesigners: "14 Classic Hairdesigns", "Scientific Approach to Hairdesign", and "Aura, Essence of Beauty".-illustrating methods of high fashion hairsetting and hairstyling.

The high quality work, that is illustrated in the enclosed copies of prior art, with the use of the invented device, may be done in less time, with less tampering with the hair, and

UNITED STATES PATENT AND TRADEMARK OFFICE

CERTIFICATE OF CORRECTION

PATENT NO. : 4,619,280

DATED : October 28, 1986

INVENTOR(S) : Ludmila Yampolskaya

It is certified that error appears in the above-identified patent and that said Letters Patent is hereby corrected as shown below:

does not require top notch skills from the hairdresser.

Signed and Sealed this

Third Day of February, 1987

*Attest:*

DONALD J. QUIGG

*Attesting Officer*

*Commissioner of Patents and Trademarks*